US011721926B2

(12) United States Patent
Kozono et al.

(10) Patent No.: US 11,721,926 B2
(45) Date of Patent: Aug. 8, 2023

(54) CONNECTOR WITH AN INTERLOCKING ROTATION MECHANISM

(71) Applicant: YAZAKI CORPORATION, Tokyo (JP)

(72) Inventors: Seiji Kozono, Kakegawa (JP); Yoshitaka Tsushima, Fujieda (JP); Masaya Okamoto, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 7 days.

(21) Appl. No.: 17/710,980

(22) Filed: Mar. 31, 2022

(65) Prior Publication Data

US 2022/0320781 A1 Oct. 6, 2022

(30) Foreign Application Priority Data

Apr. 5, 2021 (JP) ..... 2021-064369

(51) Int. Cl.
*H01R 13/453* (2006.01)

(52) U.S. Cl.
CPC ..... *H01R 13/4532* (2013.01)

(58) Field of Classification Search
CPC ..... H01R 13/453; H01R 13/4536; H01R 13/4532
USPC ..... 439/139
See application file for complete search history.

(56) References Cited

U.S. PATENT DOCUMENTS 4,176,897 A * 12/1979 Cameron ..... H01R 13/44 439/138
5,372,515 A * 12/1994 Miller ..... H01R 13/6485 439/138
5,716,224 A * 2/1998 Masuda ..... H01R 13/4536 439/138
6,520,782 B2 * 2/2003 Mori ..... B60L 53/16 439/138
6,685,362 B2 * 2/2004 Burkholder ..... G02B 6/3849 439/607.34
6,877,999 B2 * 4/2005 Hashimoto ..... H01R 13/4532 439/138
6,887,086 B2 * 5/2005 Kuroki ..... H01R 13/4532 439/138
6,908,319 B2 * 6/2005 Sasame ..... H01R 13/4536 439/137
6,935,873 B2 * 8/2005 Funatsu ..... H01R 13/4532 439/137

(Continued)

FOREIGN PATENT DOCUMENTS

JP 408-138785 A 5/1996

*Primary Examiner* — Harshad C Patel
(74) *Attorney, Agent, or Firm* — Kenealy Vaidya LLP

(57) ABSTRACT

A connector includes a housing configured to accommodate a connection terminal, a shutter that is rotatably provided in the housing and is configured to open and close a front opening of the housing, a rotation lever that is rotatably supported to the housing about a rotation axis, and an interlocking rotation mechanism provided between the rotation lever and the shutter and configured to rotate the shutter in accordance with rotation of the rotation lever. A pressing force of the mating connector, whose fitting tip end portion is moved to a position facing the front opening, acts on a lever front end portion of the rotation lever so as to rotate the rotation lever, and thus the shutter is rotated by the interlocking rotation mechanism so as to open the front opening.

5 Claims, 9 Drawing Sheets

(56) References Cited

U.S. PATENT DOCUMENTS

| | | | | |
|---|---|---|---|---|
| 7,140,892 | B2 * | 11/2006 | Takeuchi | H01R 13/6583 439/138 |
| 8,770,860 | B2 * | 7/2014 | Affre De Saint Rome | H01R 13/5213 439/138 |
| 10,348,026 | B1 | 7/2019 | Cheng et al. | |
| 10,355,390 | B2 * | 7/2019 | Ferran Palau | H01R 13/629 |
| 2020/0031235 | A1 | 1/2020 | Song et al. | |

* cited by examiner

CONNECTOR WITH AN INTERLOCKING ROTATION MECHANISM

CROSS-REFERENCE TO RELATED APPLICATIONS

This application is based on and claims priority under 35 USC 119 from Japanese Patent Application No. 2021-064369 filed on Apr. 5, 2021, the contents of which are incorporated herein by reference.

TECHNICAL FIELD

The present invention relates to a connector including a shutter mechanism.

BACKGROUND ART

In related art, a wire harness (electric wire) for electrically connecting various electrical components mounted on an automobile or the like performs connection by a connector. Such a connector is usually constituted by a male connector and a female connector. For example, in the case of a connector structure applied to optional specifications, one connector connected to an end portion of an electric wire has a shutter mechanism at a front opening of a housing of the one connector for purposes such as dust prevention, terminal protection, prevention of electric shock to the surroundings, and the like until the other connector is fitted to the one connector. In particular, a shutter-mechanism-equipped connector (inlet) is used in an electric vehicle or the like in order to prevent an electric shock accident or the like, and exposure of a terminal at a front opening of the connector when the connector is not connected to a mating connector. As an example of such a configuration, JP-A-H8-138785 discloses a shutter-mechanism-equipped connector, for example.

According to the shutter-mechanism-equipped connector, one connector is provided with a shutter that rotates outward when an external force is applied to a front surface portion thereof, the other connector is provided with a tip end portion such that the tip end portion presses the front surface portion of the shutter of the one connector to rotate the shutter when fitting the connector.

Incidentally, in the shutter-mechanism-equipped connector disclosed in JP-A-H8-138785, when fitting with the connector, a tip end portion (fitting hood portion) of a mating connector pushes the front surface portion of the shutter, so that the shutter is rotated outward (forward) around a pin and is opened. Therefore, it is necessary to set a stroke (connector size) of the mating connector in consideration of an opening rotation trajectory of the shutter so as to avoid interference when fitting with the connector. Therefore, the fitting hood portion of the mating connector is lengthened due to space for the shutter to open and close, and thus the connector size is increased.

Further, according to the shutter-mechanism-equipped connector, the shutter is rotated and opened by a pressing force in a connector fitting direction of the mating connector, and thus a terminal in the connector is opened and exposed to enable coupling with a mating terminal. Therefore, when fitting with the connector, rotation resistance against rotation of the shutter is applied in addition to insertion resistance when coupling the terminal and the mating terminal, and thus a force for fitting the connector is increased.

In addition, according to the shutter-mechanism-equipped connector, if the front surface portion of the shutter is pressed by the tip end portion of the mating connector when fitting with the connector, the shutter is rotated and opened. However, the shutter-mechanism-equipped connector can be fitted even if a relative positional relationship between the connector and the mating connector is deviated from a correct fitting position. For this reason, assembly may be performed from all angles when fitting with the connector, and when the assembly is performed from an incorrect angle, an opening and closing operation of the shutter is hindered, and thus the two connectors may not be smoothly fitted to each other.

SUMMARY OF INVENTION

The present invention has been made in view of the above circumstances, and an object thereof is to provide a compact connector that reduces a force for fitting a connector of a shutter-mechanism-equipped connector and enables smooth connector fitting.

The above object of the present invention is achieved by the following configuration.

Aspect of non-limiting embodiments of the present disclosure relates to provide a connector including:

a housing configured to accommodate a connection terminal;

a shutter that is rotatably provided in the housing and is configured to open and close a front opening of the housing to which a fitting tip end portion of a mating connector is to be fitted;

a rotation lever that is disposed on one side portion side of the front opening and is rotatably supported to the housing about a rotation axis intersecting a connector fitting direction of the mating connector, the rotation lever having a lever front end portion that extends toward a front side of the housing relative to the rotation axis; and an interlocking rotation mechanism provided between the rotation lever and the shutter and configured to rotate the shutter in accordance with rotation of the rotation lever, in which a pressing force of the mating connector, whose fitting tip end portion is moved to a position facing the front opening, acts on the lever front end portion so as to rotate the rotation lever, and thus the shutter is rotated by the interlocking rotation mechanism so as to open the front opening.

According to the connector having the above configuration, when the mating connector is moved to the position where the fitting tip end portion faces the front opening of the housing when fitting the connector, a side surface portion of the mating connector presses the lever front end portion so as to rotate the rotation lever. Then, the rotated rotation lever rotates the shutter via the interlocking rotation mechanism so as to open the front opening of the housing. Therefore, if the mating connector is moved toward the front opening along the connector fitting direction while the side surface portion presses the lever front end portion to maintain an opening state of the shutter, the fitting tip end portion of the mating connector can be fitted to the front opening of the housing.

At this time, since the rotation lever rotates the shutter via the interlocking rotation mechanism, a pressing force with which the side surface portion of the mating connector presses the lever front end portion is smaller than a pressing force with which a fitting tip end portion of a mating connector in related art directly presses a front surface portion of a shutter.

Therefore, although insertion resistance when coupling the connection terminal and the mating connection terminal acts on the mating connector moving in the connector fitting direction when fitting the connector, rotation resistance against rotation of the shutter has almost no effect, and thus a force for fitting the connector is lower than that in the related art.

In addition, according to the connector of the present configuration, it is not necessary to lengthen a fitting hood portion of the mating connector in consideration of opening and closing trajectories of the shutter as in the shutter-mechanism-equipped connector in the related art.

According to the present invention, it is possible to provide the compact connector that reduces the force for fitting the connector of the shutter-mechanism-equipped connector and enables smooth connector fitting.

The present invention has been briefly described above. Further, details of the present invention will be further clarified by reading through embodiments described below (hereinafter referred to as the "embodiments") with reference to the accompanying drawings.

BRIEF DESCRIPTION OF DRAWINGS

FIGS. 4A and 4B are perspective views showing a multi-link mechanism shown in FIG. 2, among which FIG. 4A shows a shutter closed state while FIG. 4B shows a shutter opened state;

FIGS. 5A and 5B are side views showing a fitting operation of the inlet and the inlet plug, among which FIG. 5A shows a fitting start state while FIG. 5B shows a fitting intermediate state;

FIGS. 9A and 9B are side views showing a fitting operation of an inlet constituting a connector according to another embodiment of the present invention and an inlet plug that is a mating connector to be fitted to the inlet, among which FIG. 9A shows a fitting start state while FIG. 9B shows a fitting intermediate state.

DESCRIPTION OF EMBODIMENTS

Hereinafter, an example of an embodiment according to the present invention will be described with reference to the drawings.

Figure 1:
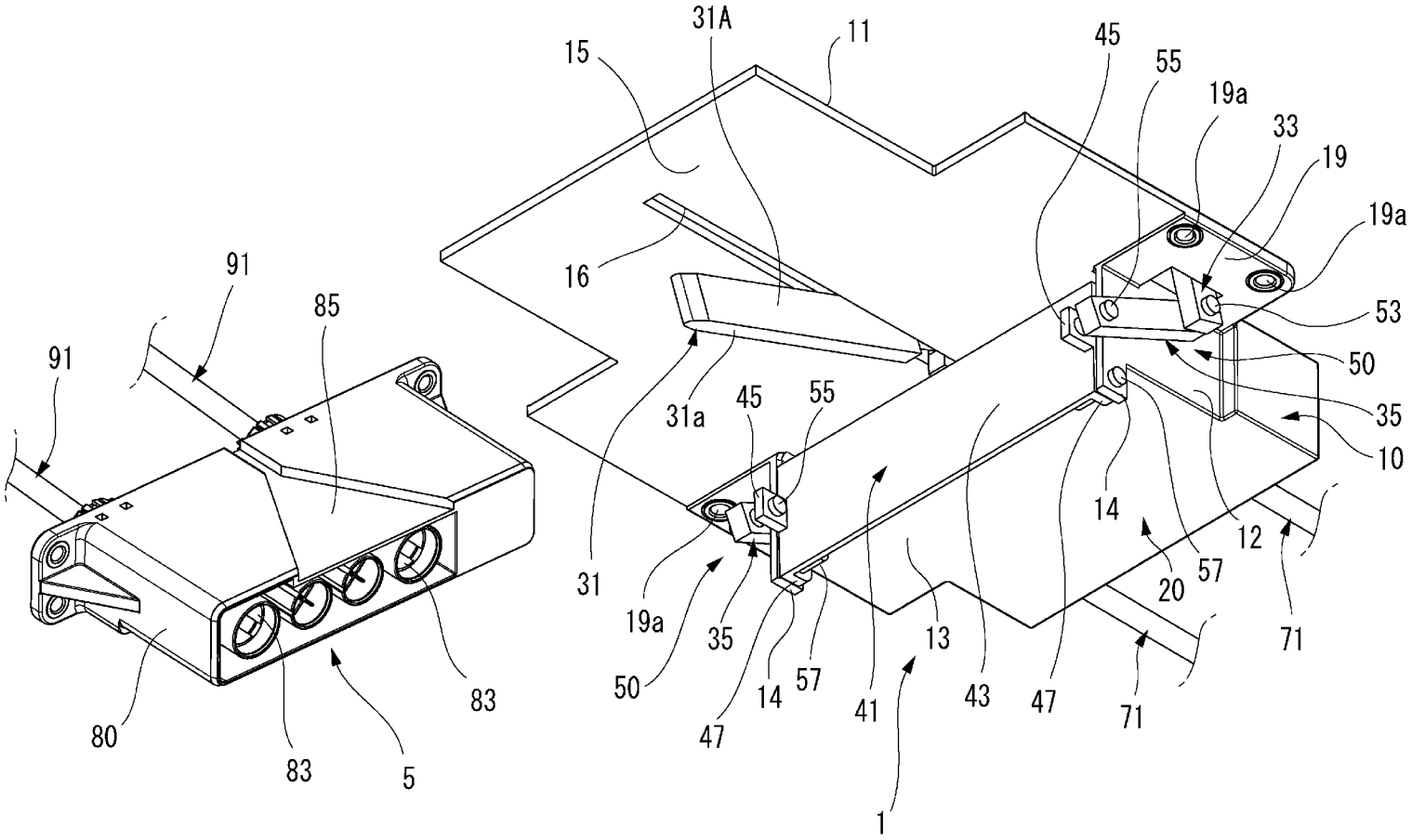
FIG. 1 is a perspective view showing an inlet constituting a connector according to an embodiment of the present invention and an inlet plug that is a mating connector to be fitted to the inlet.
Figure 2:
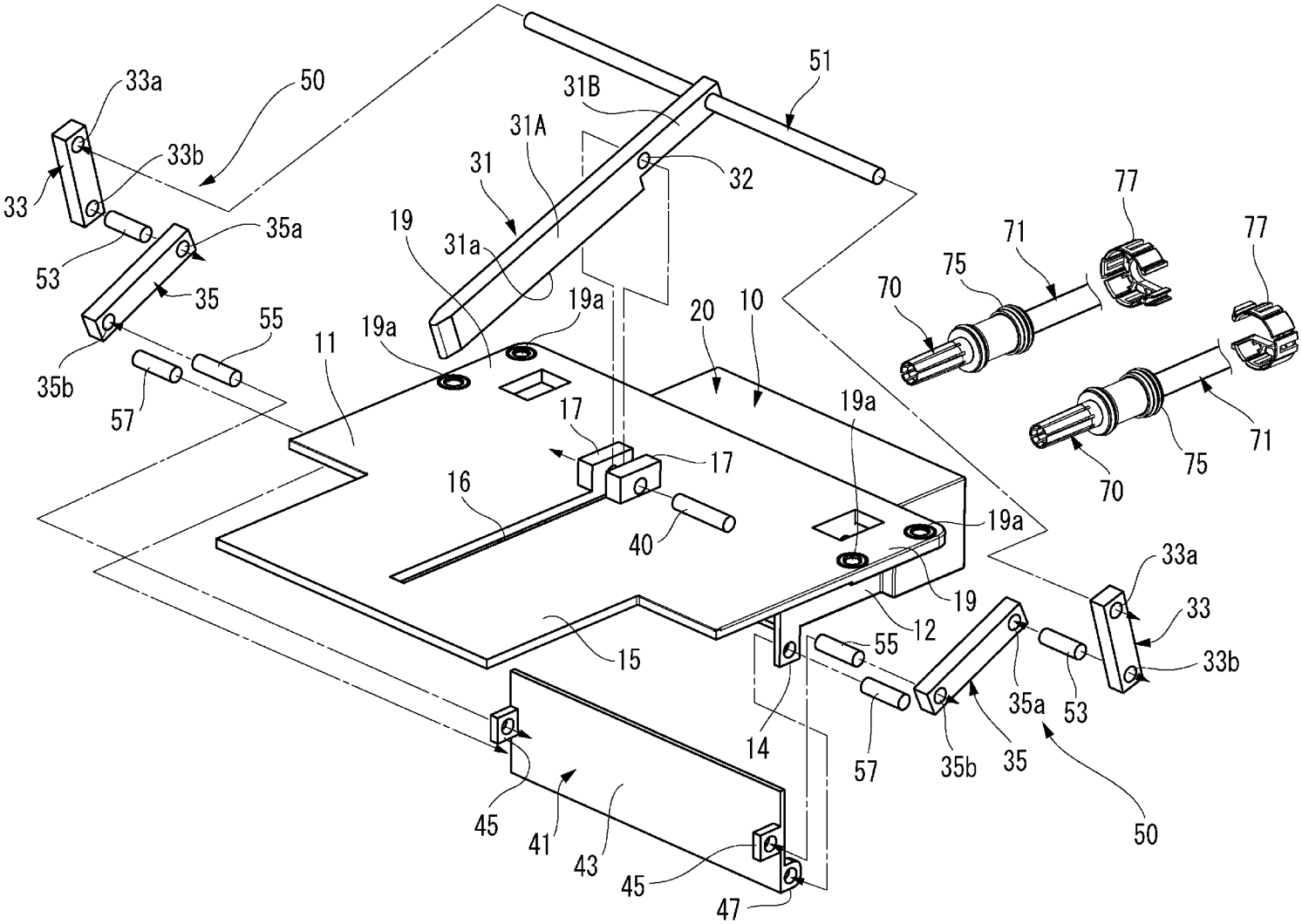
FIG. 2 is an exploded perspective view of the inlet.
Figure 3:
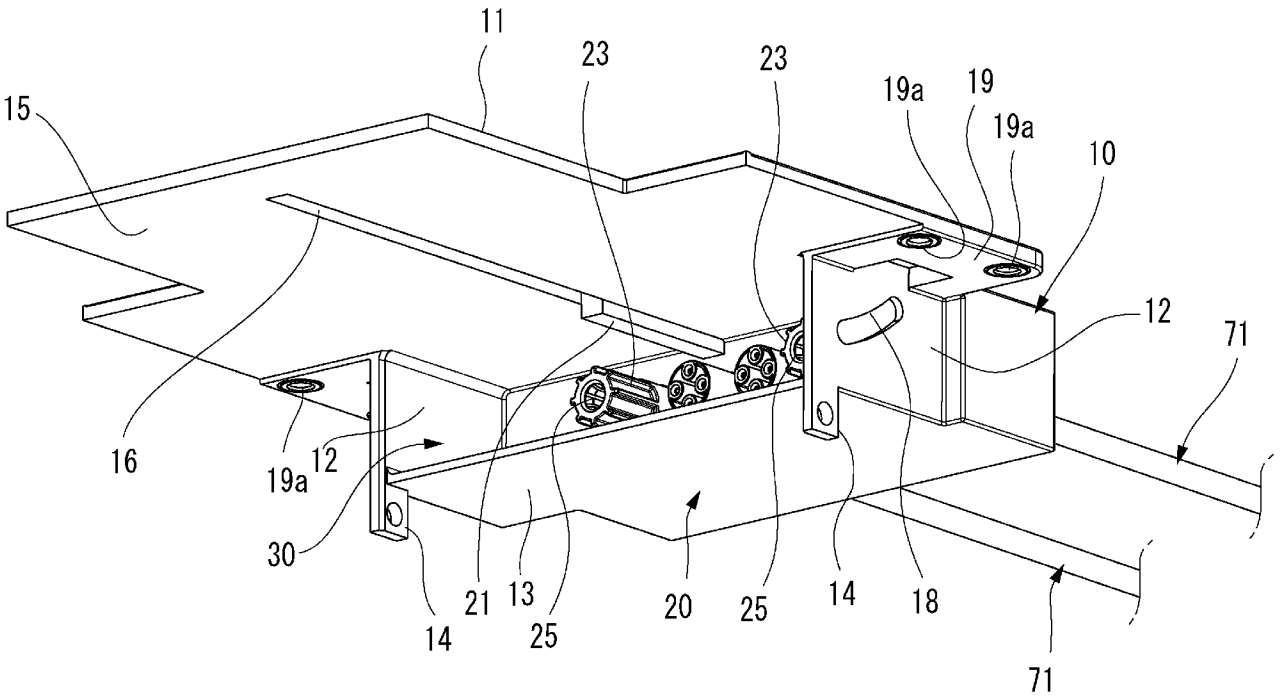
FIG. 3 is a perspective view of a housing shown in FIG. 2.
Figure 4A:
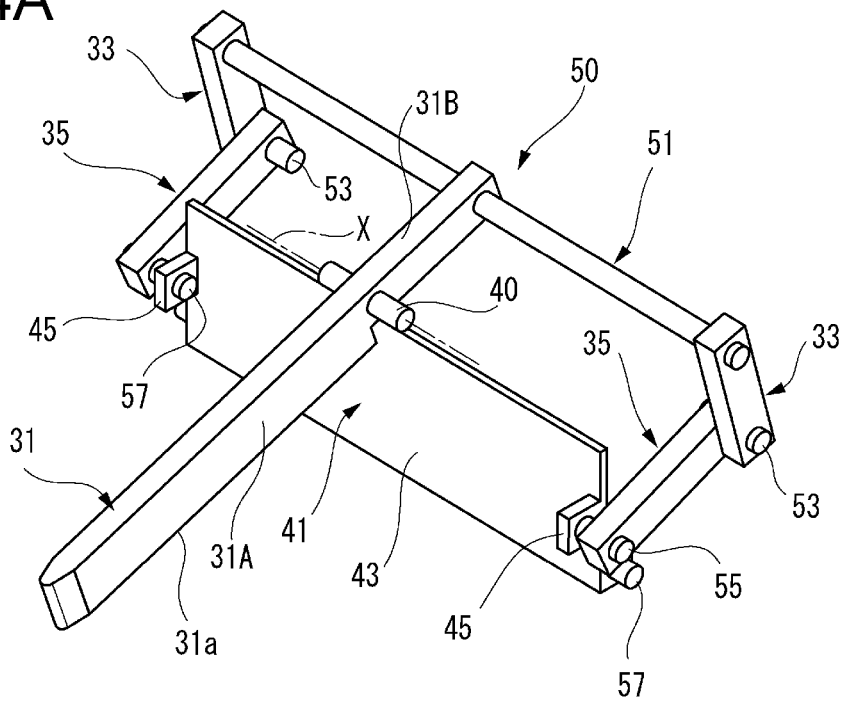
Figure 4B:
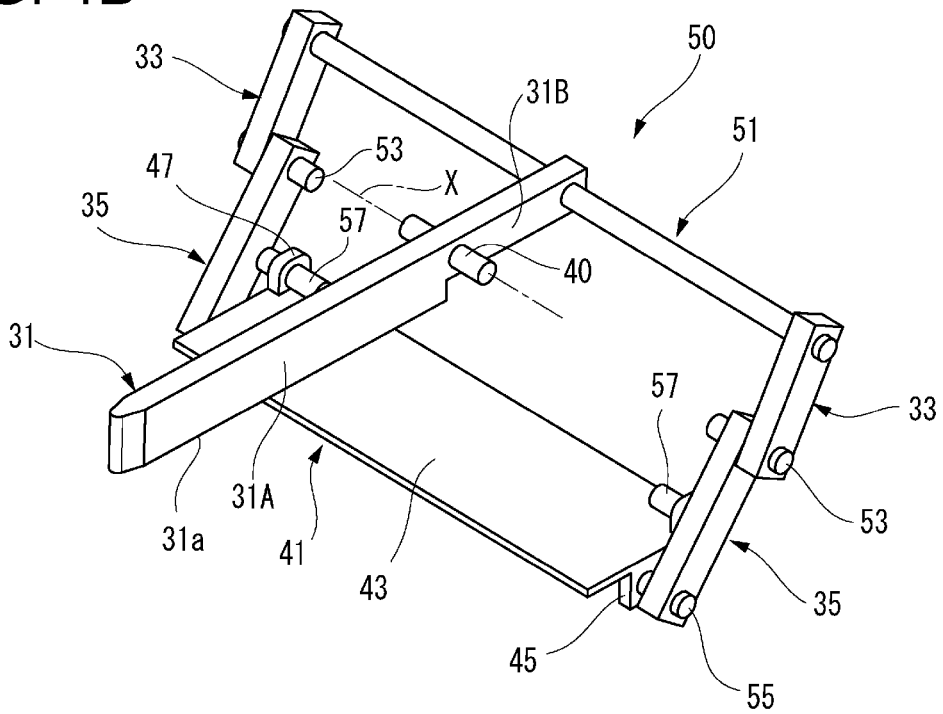

FIG. 1 is a perspective view showing an inlet 1 constituting a connector according to the embodiment of the present invention and an inlet plug 5 that is a mating connector to be fitted to the inlet 1. FIG. 2 is an exploded perspective view of the inlet 1. FIG. 3 is a perspective view of a housing 10 shown in FIG. 2. FIGS. 4A and 4B are perspective views showing a multi-link mechanism 50 shown in FIG. 2, among which FIG. 4A shows a shutter closed state while FIG. 4B shows a shutter opened state.

As shown in FIG. 1, the inlet 1, which is the connector according to the present embodiment, includes the housing 10. A plug housing 80 of the inlet plug (mating connector) 5 is fitted to the housing 10. As a result, a connection terminal 70 accommodated in the inlet 1 and a mating connection terminal 90 accommodated in the inlet plug 5 are electrically connected to each other.

In the present specification, a front-rear direction is a direction along a connector fitting direction (left-right direction in FIGS. 5A and 5B) of the housing 10, a side where the plug housing 80 of the inlet plug 5 is fitted is defined as a front side, an up-down direction is a direction that is orthogonal to the connector fitting direction of the housing 10 and in which a shutter 41 is opened and closed (up-down direction in FIGS. 5A and 5B), and a side where an upper wall portion 11 of the housing 10 is located is defined as an upper side.

As shown in FIGS. 2 to 4B, the inlet 1 includes the housing 10, a rotation lever 31, the shutter 41, and the multi-link mechanism 50 that is an interlocking rotation mechanism.

The housing 10 of the present embodiment is formed of an electrically insulating synthetic resin. As shown in FIG. 3, the housing 10 includes the rectangular upper wall portion 11 and a terminal accommodating portion 20 provided at a rear portion of the upper wall portion 11. The terminal accommodating portion 20 is provided with a pair of terminal accommodating cylindrical portions 23, 23 protruding toward the inlet plug 5.

The connection terminal 70, which is connected to an end portion of a high-voltage cable 71, is accommodated in each terminal accommodating cylindrical portion 23. A front surface opening 25 into which the mating connection terminal 90 of the inlet plug 5 is inserted is formed in a front end of each terminal accommodating cylindrical portion 23. The high-voltage cable 71 connected to the connection terminal 70 is drawn out from a rear end opening of each terminal accommodating cylindrical portion 23.

The connection terminal 70 is a female terminal formed of a conductive metal material, and is constituted by a plurality of flexible pieces arranged in a cylindrical shape. A joining hole 72 is formed in a rear end portion of the connection terminal 70. A conductor 73 of the high-voltage cable 71 drawn out from the rear end opening of the terminal accommodating cylindrical portion 23 is inserted into the joining hole 72, crimped and connected thereto (see FIGS. 7 and 8).

A seal member 75 is mounted to the high-voltage cable 71 drawn out from the rear end opening of the terminal accommodating cylindrical portion 23, and thus the high-voltage cable 71 is liquid-tightly sealed relative to the terminal accommodating cylindrical portion 23. Detachment of the seal member 75 is restricted by a rear holder 77 mounted to a rear end of the terminal accommodating cylindrical portion 23 (see FIGS. 7 and 8).

In a front portion of the terminal accommodating portion 20, a front opening 30 into which a fitting tip end portion of the plug housing 80 is fitted is defined by a pair of side wall portions 12 and a bottom wall portion 13 that extend forward.

Further, in the housing 10, an eaves portion 15 is provided to extend in front of the upper wall portion 11. A slit 16 extending in the connector fitting direction over the eaves portion 15 is formed in a central portion of the upper wall portion 11.

A pair of shaft support portions 17 that pivotally support a support pin 40 are provided on an upper surface of the upper wall portion 11 at a rear side end of the slit 16. In addition, on a lower surface of the upper wall portion 11 at the rear side end of the slit 16, a pick-up rib 21 for guiding the plug housing 80 of the inlet plug 5 to be fitted into the front opening 30 is provided to extend along the connector fitting direction.

The housing 10 includes fixing portions 19 protruding laterally on the upper wall portion 11. Hole portions 19*a* through which attachment screws (not shown) pass are formed in the fixing portions 19.

A shutter support portion 14 for supporting the shutter 41 in a freely openable and closable manner is provided so as to protrude downward on a front end of a lower edge of each of the two side wall portions 12 of the housing 10.

A cam groove 18 is formed to penetrate one (right one in FIG. 3) of the side wall portions 12 of the housing 10. The cam groove 18 is formed by an arc-shaped opening that extends obliquely upward from a front end side of the side wall portion 12 toward the rear.

As shown in FIGS. 2, 4A and 4B, the rotation lever 31 of the present embodiment is a rod-shaped lever having a rectangular cross section, and is rotatably supported by the pair of shaft support portions 17 via the support pin 40 that is fitted into a through hole 32 formed in the vicinity of a rear end of a longitudinal direction intermediate portion of the rotation lever 31. The pair of shaft support portions 17 are disposed on the upper wall portion 11 located on one side portion side (upper side portion side) of the front opening 30. Therefore, the rotation lever 31 is disposed on an upper side portion side of the front opening 30 and is rotatably supported relative to the housing 10 about a rotation axis X (center line of the support pin 40) that intersects the connector fitting direction.

The rotation lever 31 includes a lever front end portion 31A extending toward the front of the housing 10 relative to the rotation axis X (through hole 32) and a lever rear end portion 31B extending toward the rear of the housing 10 relative to the rotation axis X (through hole 32).

The lever front end portion 31A is formed to have a larger up-down width than the lever rear end portion 31B due to a longitudinal direction side portion 31*a* extending downward along a longitudinal direction. A first connection pin 51 that pivotally supports a pin hole 33*a* of a first link 33 (one link end portion) in the multi-link mechanism 50 to be described later is fitted into the lever rear end portion 31B. The first connection pin 51 is fitted to the rotation lever 31 so as to intersect the longitudinal direction of the rotation lever 31 and extend in parallel with the rotation axis X.

Here, the rotation lever 31 that is pivotally supported by the shaft support portion 17 via the support pin 40 is inclined such that the lever front end portion 31A that is heavier than the lever rear end portion 31B penetrates the slit 16 and protrudes below the eaves portion 15. In addition, in a horizontal state where a rotation force is applied and the rotation lever 31 is parallel to the upper wall portion 11, the longitudinal direction side portion 31*a* of the lever front end portion 31A penetrates the slit 16 and protrudes to a lower surface side of the eaves portion 15.

As shown in FIG. 2, the shutter 41 of the present embodiment includes a cover portion 43 that has a rectangular flat plate shape, rotation support portions 47 provided to protrude below inner surfaces of two left-right direction end portions of the cover portion 43, and shutter joint portions 45 provided to protrude in the middle of the up-down direction on outer surfaces of the two left-right direction end portions of the cover portion 43.

Each rotation support portion 47 is pivotally supported via a support pin 57 that is fitted into a through hole of the shutter support portion 14 of the housing 10, and thus serves as a rotation center of the cover portion 43 rotated in an opening and closing direction.

A third connection pin 55 fitted into a pin hole 35*b* of a second link 35 (the other link end portion) in the multi-link mechanism 50 to be described later is fitted into a through hole of each shutter joint portion 45, which is a swinging portion of the shutter 41.

Since the cover portion 43 covers the front opening 30 provided in front of the terminal accommodating portion 20, the shutter 41 can prevent the connection terminal 70 from being exposed in the front opening 30 when the inlet 1 is not connected.

As shown in FIGS. 2, 4A, and 4B, the multi-link mechanism 50 of the present embodiment is an interlocking rotation mechanism that is provided between the lever rear end portion 31B of the rotation lever 31 and each shutter joint portion 45 of the shutter 41 so as to rotate the shutter 41 in conjunction with rotation of the rotation lever 31. The multi-link mechanism 50 is disposed outside each of the two side wall portions 12 of the housing 10. Such multi-link mechanisms 50 are respectively connected to two end portions of the first connection pin 51 fitted into the lever rear end portion 31B, and are synchronously operated in conjunction with the rotation of the rotation lever 31.

The multi-link mechanism 50 includes the first link 33, the first connection pin 51 that connects the lever rear end portion 31B of the rotation lever 31 and the first link 33 in a freely rotatable manner, the second link 35, a second connection pin 53 that connects the first link 33 and the second link 35 in a freely rotatable manner, the third connection pin 55 that connects each shutter joint portion 45 of the shutter 41 and the second link 35 in a freely rotatable manner, and the cam groove 18 formed in the one side wall portion 12 of the housing 10.

An outer end of the second connection pin 53 is fitted into a pin hole 33*b* of the first link 33, and an inner end thereof is fitted into a pin hole 35*a* of the second link 35. An outer end of the third connection pin 55 is fitted into the pin hole 33*b* of the second link 35, and an inner end thereof is fitted into the through hole of each shutter joint portion 45. The inner end of the second connection pin 53 disposed outside the one side wall portion 12 penetrates the pin hole 35*a* of the second link 35 and is engaged with the cam groove 18. The second connection pin 53 is engaged with (driven by) the cam groove 18, so that a movement direction thereof is guided in an opening and closing direction of the shutter 41.

Therefore, the multi-link mechanism 50 of the present embodiment constitutes a speed increasing mechanism by appropriately setting lengths of the first link 33 and the second link 35 and a shape of the cam groove 18. That is, the multi-link mechanism 50 can increase a speed of the rotation of the rotation lever 31 so as to rotate the shutter 41.

As shown in FIG. 4A, in a state where the lever front end portion 31A of the rotation lever 31 is inclined obliquely downward, the multi-link mechanism 50 holds the shutter 41 at a position where the cover portion 43 of the shutter 41 intersects the connector fitting direction and covers the front opening 30 of the housing 10. In addition, as shown in FIG. 4B, in a horizontal state where the lever front end portion 31A of the rotation lever 31 is parallel to the connector fitting direction, the multi-link mechanism 50 holds the shutter 41 at a position where the cover portion 43 of the shutter 41 is parallel to the connector fitting direction and the front opening 30 of the housing 10 is opened (see FIG. 6).

In the assembled inlet 1, the front opening 30 provided in front of the terminal accommodating portion 20 of the housing 10 is covered by the shutter 41. As a result, the connection terminal 70 is prevented from being exposed in the front opening 30 when the inlet 1 is not connected.

The inlet 1 is attached to, for example, a vehicle body of an electric vehicle by a screw inserted into the hole portion 19*a* of each fixing portion 19 formed in the upper wall portion 11 of the housing 10. Here, the up-down direction of the vehicle body is the up-down direction of the inlet 1 at the time of attachment to the vehicle body.

Figure 7:
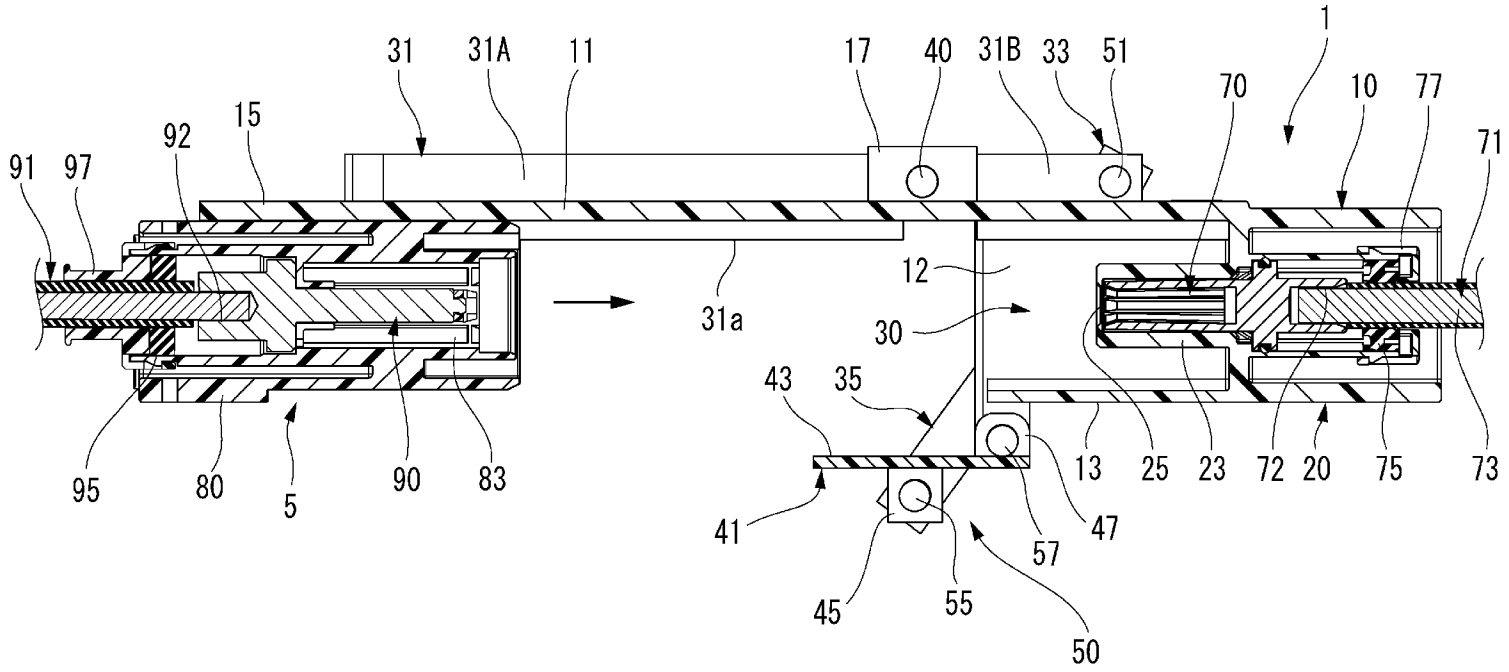
FIG. 7 is a vertical cross-sectional view of a connection terminal portion when the mating connector is moved to a position where a fitting tip end portion faces a front opening of the housing.

As shown in FIGS. 1 and 7, the inlet plug 5 to be fitted and electrically connected to the inlet 1 includes the mating connection terminal 90 to be fitted to the connection terminal 70 of the inlet 1, and the plug housing 80 that includes a pair of terminal accommodating chambers 83 for accommodating the mating connection terminal 90.

The plug housing 80 is formed of an electrically insulating synthetic resin. A fitting guide groove 85 is formed in an upper surface of the plug housing 80. The fitting guide groove 85 has a tapered portion whose width increases toward the inlet 1. When the inlet plug 5 is fitted to the inlet 1, the fitting guide groove 85 is engaged with the pick-up rib 21 provided on the upper wall portion 11 of the inlet 1, so that the plug housing 80 can be fitted and guided to the housing 10.

The mating connection terminal 90, which is connected to an end portion of a high-voltage cable 91, is accommodated in each terminal accommodating chamber 83. The high-voltage cable 91 connected to the mating connection terminal 90 is drawn out from a rear end opening of each terminal accommodating chamber 83.

The mating connection terminal 90 is a male terminal formed of a conductive metal material, and is formed in a cylindrical rod shape. A joining hole 92 is formed in a rear end portion of the mating connection terminal 90. A conductor 93 of the high-voltage cable 91 drawn out from the rear end opening of the terminal accommodating chamber 83 is inserted into the joining hole 92, crimped and connected thereto.

A seal member 95 is mounted to the high-voltage cable 91 drawn out from the rear end opening of the terminal accommodating chamber 83, and thus the high-voltage cable 91 is liquid-tightly sealed relative to the terminal accommodating chamber 83. Detachment of the seal member 95 is restricted by a rear holder 97 mounted to a rear end of the terminal accommodating chamber 83.

Next, a case where the inlet plug 5 is fitted to and detached from the inlet 1 having the above-described configuration will be described.

Figure 5A:
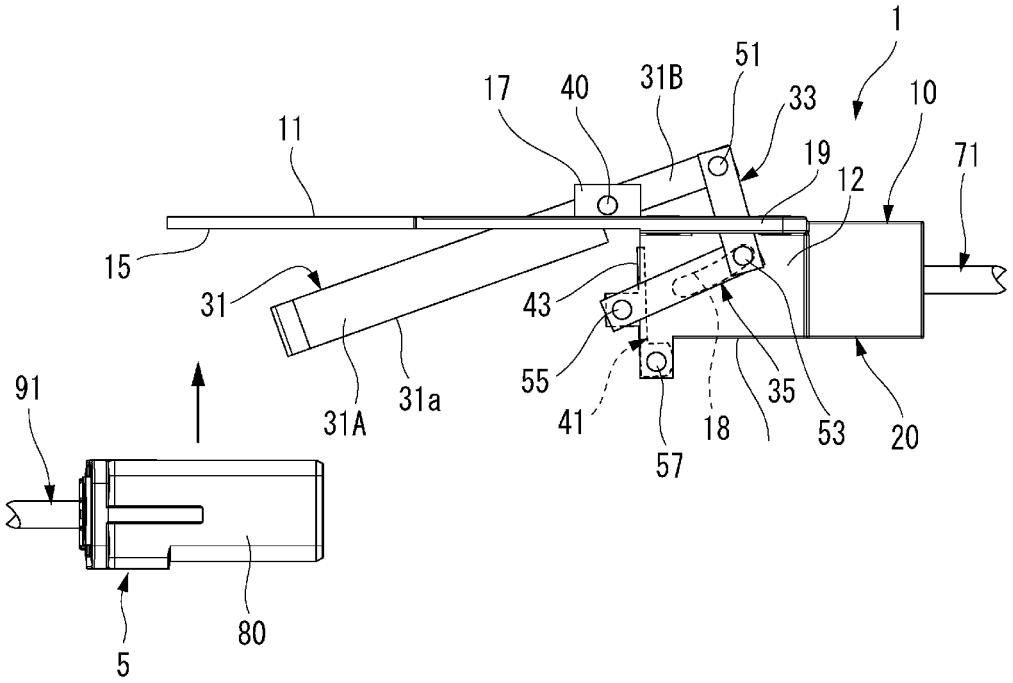
Figure 5B:
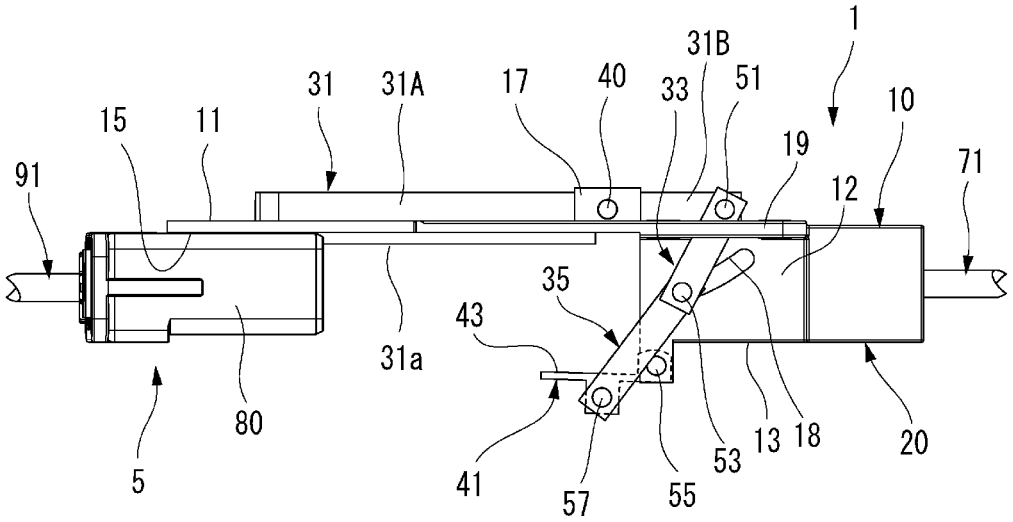
Figure 6:
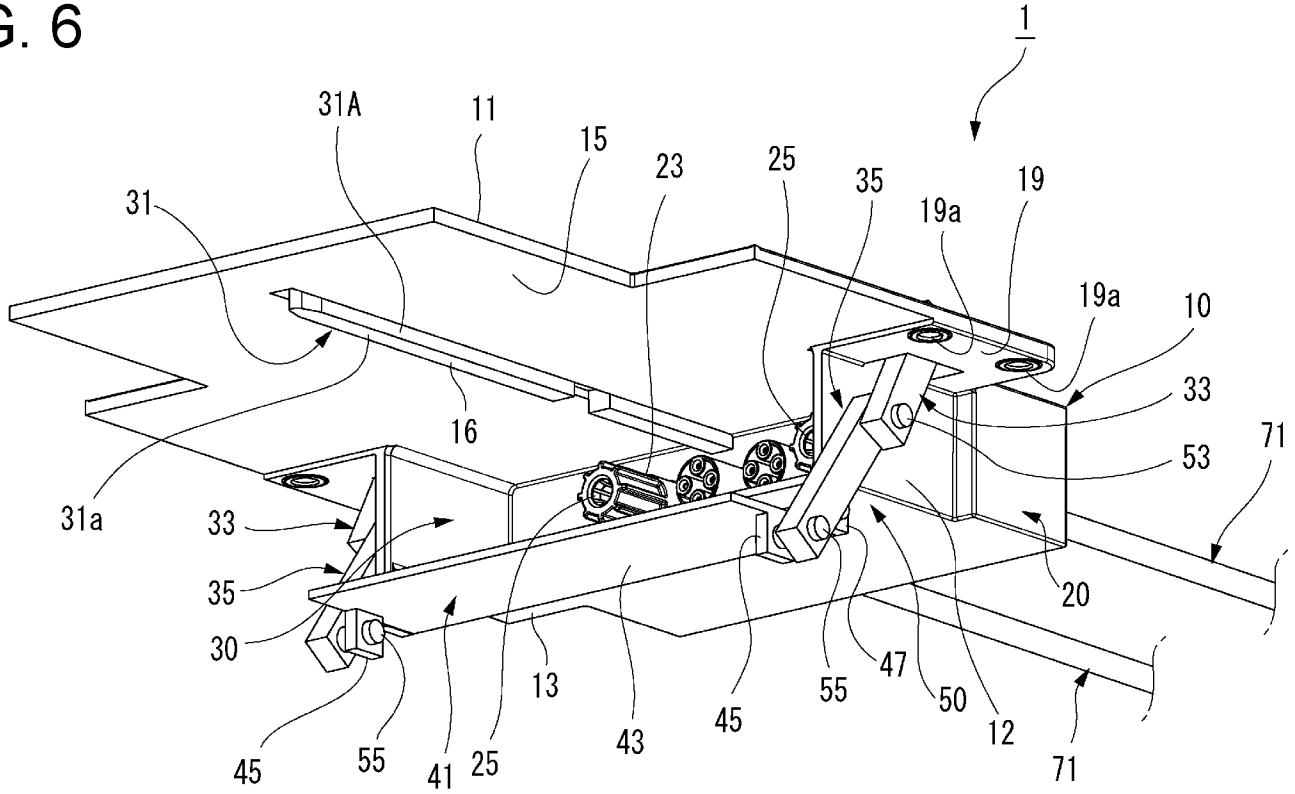
FIG. 6 is a perspective view, in which the inlet plug is omitted, of the inlet during fitting.
Figure 8:
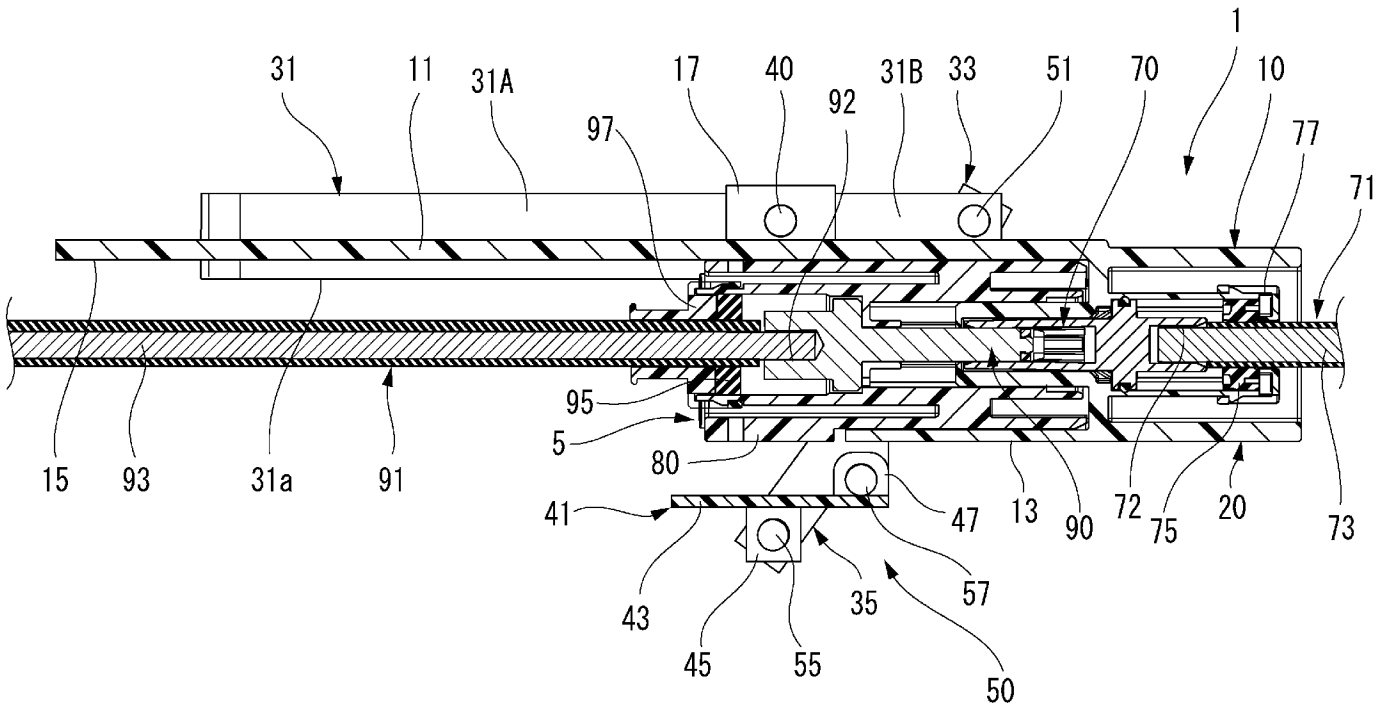
FIG. 8 is a vertical cross-sectional view of the connection terminal portion between the inlet and the inlet plug during fitting.

FIGS. 5A and 5B are side views showing a fitting operation of the inlet 1 and the inlet plug 5, among which FIG. 5A shows a fitting start state while FIG. 5B shows a fitting intermediate state. FIG. 6 is a perspective view, in which the inlet plug 5 is omitted, of the inlet 1 during fitting. FIG. 7 is a vertical cross-sectional view of a connection terminal portion when the inlet plug 5 is moved to a position where the fitting tip end portion faces the front opening 30 of the housing 10. FIG. 8 is a vertical cross-sectional view of the connection terminal portion between the inlet 1 and the inlet plug 5 during fitting.

(During Fitting)

As shown in FIG. 5A, the shutter 41 is disposed in front of the terminal accommodating portion 20 of the housing 10 in a state where the inlet plug 5 is located below the eaves portion 15 and a fitting tip end portion of the inlet plug 5 does not face the front opening 30 of the housing 10 (see FIG. 1). As a result, the front opening 30 of the terminal accommodating portion 20 is in a closed state of being covered by the shutter 41. Therefore, the shutter 41 is closed and the connection terminal 70 of the inlet 1 is not exposed. As a result, the inlet 1 is subjected to dust prevention and terminal protection, and is prevented from electric shock.

From this state, as shown in FIG. 5B, the inlet plug 5 is moved upward until the upper surface of the plug housing 80 is abutted against the lower surface of the eaves portion 15. As a result, the inlet plug 5 can be moved to the position where the fitting tip end portion faces the front opening 30 of the housing 10. Then, the upper surface of the plug housing 80, which is a side surface portion of the inlet plug 5, presses the lever front end portion 31A so as to rotate the rotation lever 31.

The multi-link mechanism 50 rotates the shutter 41 in conjunction with the rotation of the rotation lever 31. The multi-link mechanism 50 can increase the speed of the rotation of the rotation lever 31 so as to rotate the shutter 41. Therefore, as shown in FIG. 6, the rotated rotation lever 31 rotates the shutter 41 via the multi-link mechanism 50 so as to open and close the front opening 30 of the housing 10.

Next, the inlet plug 5 is moved toward the front opening 30 along the connector fitting direction while the upper surface of the plug housing 80 presses the lever front end portion 31A to maintain a state where the shutter 41 is opened.

Then, as shown in FIG. 8, the fitting tip end portion of the inlet plug 5 can be fitted into the front opening 30 of the housing 10. When the connection terminal 70 of the inlet 1 and the mating connection terminal 90 of the inlet plug 5 are fitted and connected to each other, the high-voltage cable 71 and the high-voltage cable 91 are electrically connected to each other.

At this time, since the rotation lever 31 rotates the shutter 41 via the multi-link mechanism 50 which is the interlocking rotation mechanism, a pressing force with which an upper surface of the inlet plug 5 presses the lever front end portion 31A is smaller than a pressing force with which a fitting tip end portion of an inlet plug in related art directly presses a front surface portion of a shutter.

Therefore, although insertion resistance when coupling the connection terminal 70 and the mating connection terminal 90 acts on the inlet plug 5 moving in the connector fitting direction when fitting the connector, rotation resistance against rotation of the shutter 41 has almost no effect, and thus a force for fitting the connector is lower than that in the related art.

In addition, according to the inlet 1 of the present embodiment, it is not necessary to lengthen a fitting hood portion of the inlet plug 5 in consideration of opening and closing trajectories of the shutter 41 as in a shutter-mechanism-equipped connector in the related art.

(During Detachment)

When the inlet plug 5 is pulled out from the inlet 1 in order to detach the inlet plug 5 from the inlet 1, the mating connection terminal 90 of the inlet plug 5 is pulled out from the connection terminal 70 of the inlet 1. As a result, the electrical connection between the high-voltage cable 71 and the high-voltage cable 91 is released.

When the inlet plug 5 is pulled out, the upper surface of the plug housing 80 pressing the lever front end portion 31A of the rotation lever 31 upward is separated from the rotation lever 31. Therefore, as shown in FIG. 5A, the rotation lever 31 is inclined due to own weight so that the lever front end portion 31A penetrates the slit 16 and protrudes below the eaves portion 15.

Therefore, the inlet 1 is in a closed state where the front opening 30 of the housing 10, which has been opened, is covered by the shutter 41. Therefore, the connection terminal 70 of the inlet 1 is not exposed due to the closing of the shutter 41, thus the inlet 1 is subjected to dust prevention, terminal protection and is prevented from electric shock.

As described above, according to the inlet 1 of the present embodiment, the rotation speed of the rotation lever 31 is increased by the multi-link mechanism 50 that serves as the interlocking rotation mechanism including the speed increasing mechanism, and thus the shutter 41 can be rotated. Therefore, rotation necessary for the rotation lever 31 to open and close the shutter 41 is reduced, and thus a stroke (stroke in a direction intersecting the connector fitting direction) for the upper surface of the plug housing 80 of the inlet plug 5 to press the lever front end portion 31A can be reduced. As a result, a work space required in the direction intersecting the connector fitting direction when fitting the inlet plug 5 to the inlet 1 is reduced.

In addition, according to the inlet 1 of the present embodiment, the rotation lever 31 pressed and rotated by the upper surface of the plug housing 80 of the inlet plug 5 can rotate the shutter 41 by the simple interlocking rotation mechanism constituted by the multi-link mechanism 50 provided between the rotation lever 31 and the shutter 41 so as to open the front opening 30 of the housing 10.

In addition, in the inlet 1 according to the present embodiment, when fitting the connector, the longitudinal direction side portion 31*a* of the lever front end portion 31A of the rotation lever 31 is parallel to the connector fitting direction, so that the longitudinal direction side portion 31*a* is engaged with the fitting guide groove 85 formed in the upper surface of the plug housing 80 of the inlet plug 5. Therefore, when the inlet plug 5 is moved toward the front opening 30 of the inlet 1 along the connector fitting direction, the longitudinal direction side portion 31*a* can guide the fitting tip end portion of the inlet plug 5 to be fitted into the front opening 30 of the housing 10, and thus the two connectors can be smoothly fitted to each other.

Therefore, according to the inlet 1 according to the present embodiment, it is possible to provide a compact connector that reduces the force for fitting the connector and enables smooth connector fitting.

It should be noted that the present invention is not limited to the above-described embodiment, and modifications, improvements, and the like can be made as appropriate. In addition, materials, shapes, dimensions, numbers, arrangement positions, and the like of the respective constituent elements in the above-described embodiment are set as desired and are not limited as long as the present invention can be achieved.

For example, although a configuration in which the rotation speed of the rotation lever 31 is increased by the multi-link mechanism 50 so as to rotate the shutter 41 is exemplified in the above-described embodiment, the rotation of the rotation lever 31 may rotate the shutter 41 by a gear mechanism.

Figure 9A:
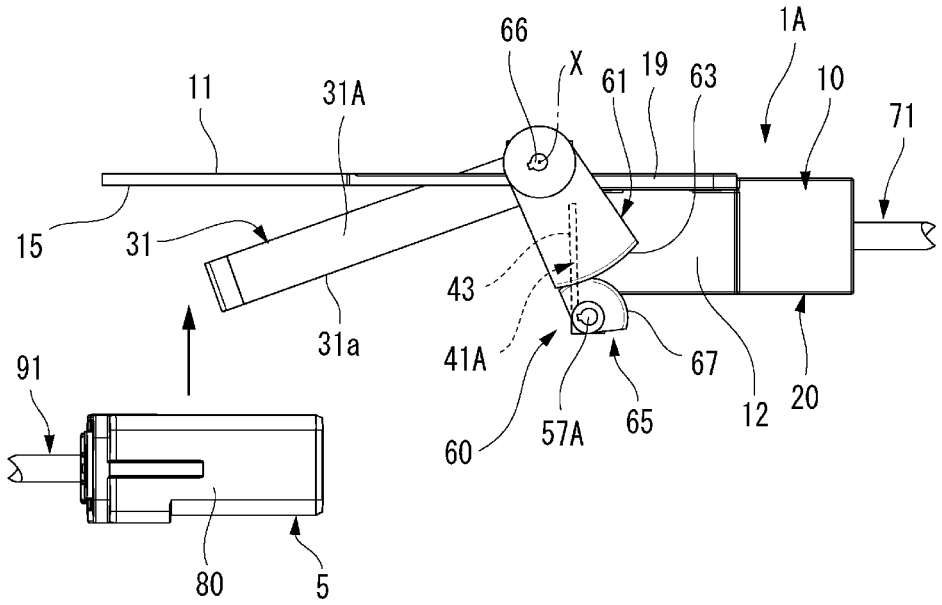
Figure 9B:
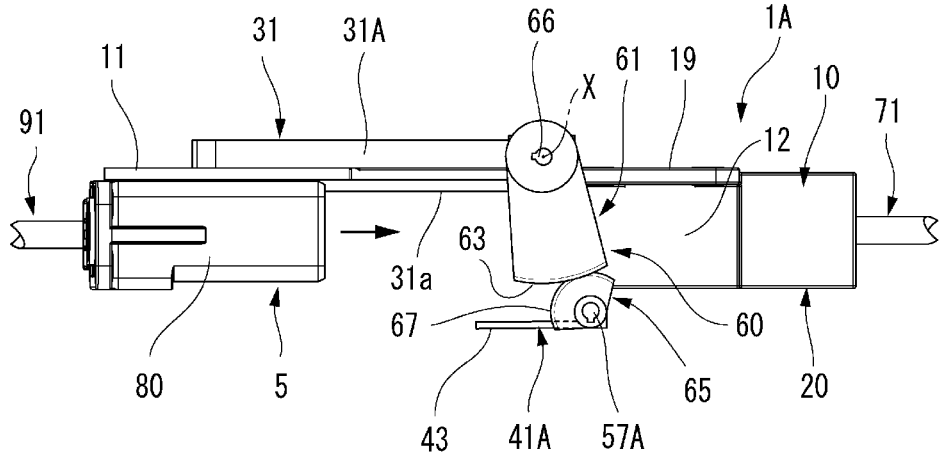

FIGS. 9A and 9B are side views showing a fitting operation of an inlet 1A according to another embodiment of the present invention and the inlet plug 5 to be fitted to the inlet 1A, among which FIG. 9A shows a fitting start state while FIG. 9B shows a fitting intermediate state. It should be noted that components substantially the same as those of the inlet 1 in the above embodiment are denoted by the same reference numerals, and detailed description thereof will be omitted.

The inlet 1A is configured such that the rotation of the rotation lever 31 rotates a shutter 41A by a gear mechanism 60.

A support shaft pin 66 that is fixed to a rear end of the rotation lever 31 so as to extend along the rotation axis X intersecting the longitudinal direction of the rotation lever 31 is pivotally supported by the pair of shaft support portions 17 so as to be freely rotatable relative to the upper wall portion 11.

The gear mechanism 60 includes a first gear portion 61 that is fixed to an end portion of the support shaft pin 66 and rotates integrally with the rotation lever 31, and a second gear portion 65 that is fixed to an end portion of a support pin 57A that rotates integrally with the shutter 41A. Gear teeth 63 of the first gear portion 61 and gear teeth 67 of the second gear portion 65 mesh with each other so as to constitute an interlocking rotation mechanism that rotates the shutter 41A in conjunction with the rotation of the rotation lever 31. Further, the first gear portion 61 and the second gear portion 65 are set to have a gear ratio that increases the speed of the rotation of the rotation lever 31 so as to rotate the shutter 41A, and thus constitute a speed increasing mechanism.

The gear mechanism 60 is disposed outside each of the two side wall portions 12 of the housing 10. Such gear mechanisms 60 are respectively fixed to two end portions of the support shaft pin 66 fixed to the rear end of the rotation lever 31, and are synchronously operated in conjunction with the rotation of the rotation lever 31.

As shown in FIG. 9A, in the state where the lever front end portion 31A of the rotation lever 31 is inclined obliquely downward, the gear mechanism 60 holds the shutter 41A at a position where the cover portion 43 of the shutter 41A intersects the connector fitting direction and covers the front opening 30 of the housing 10.

In addition, as shown in FIG. 9B, in the horizontal state where the lever front end portion 31A of the rotation lever 31 is parallel to the connector fitting direction, the gear mechanism 60 holds the shutter 41A at a position where the cover portion 43 of the shutter 41A is parallel to the connector fitting direction and the front opening 30 of the housing 10 is opened.

Therefore, according to the inlet 1A of the other embodiment, the rotation lever 31 pressed and rotated by the upper surface of the inlet plug 5 can rotate the shutter 41A by the simple interlocking rotation mechanism constituted by the gear mechanism 60 provided between the rotation lever 31 and the shutter 41A so as to open and close the front opening 30 of the housing 10.

In addition, although the inlet used in an electric vehicle or the like has been described as an example of a shutter-mechanism-equipped connector in the above embodiment, the connector of the present invention is not limited thereto. The present invention can be applied to various connectors based on the spirit of the present invention.

Here, features of the embodiments of the connector according to the present invention described above will be briefly summarized and listed in the following [1] to [5].

[1] A connector (inlet 1, inlet 1A) includes:

a housing (10) configured to accommodate a connection terminal (70);

a shutter (41, 41A) that is rotatably provided in the housing (10) and is configured to open and close a front opening (30) of the housing (10) to which a fitting tip end portion of a mating connector (inlet plug 5) is to be fitted;

a rotation lever (31) that is disposed on one side portion side of the front opening (30) and is rotatably supported to the housing (10) about a rotation axis (X) intersecting a connector fitting direction of the mating connector (inlet plug 5), the rotation lever (31) having a lever front end portion (31A) that extends toward a front side of the housing (10) relative to the rotation axis (X); and an interlocking rotation mechanism (multi-link mechanism 50, gear mechanism 60) provided between the rotation lever (31) and the shutter (41, 41A) and is configured to rotate the shutter (41, 41A) in accordance with rotation of the rotation lever (31), in which a pressing force of the mating connector (inlet plug 5), whose fitting tip end portion is moved to a position facing the front opening (30), acts on the lever front end portion so as to rotate the rotation lever (31), and thus the shutter (41, 41A) is rotated by the interlocking rotation mechanism (multi-link mechanism 50, gear mechanism 60) so as to open the front opening (30).

[2] The connector (inlet 1, inlet 1A) according to [1], in which the interlocking rotation mechanism (multi-link mechanism 50, gear mechanism 60) includes a speed increasing mechanism configured to increase a speed of the rotation of the rotation lever (31) to rotate the shutter (41, 41A).

[3] The connector (inlet 1) according to [1] or [2], in which the interlocking rotation mechanism includes a first link (33) and a second link (35) which is rotatably connected to the first link (33), and an end portion (pin hole 33*a*) of the first link (33) is pivotally supported by a lever rear end portion (31B) extending toward a rear side of the housing (10) relative to the rotation axis (X) and an end portion (pin hole 35*b*) of the second link (35) is pivotally supported by a swinging portion (shutter joint portion 45) of the shutter (41).

[4] The connector according to [1] or [2], in which the interlocking rotation mechanism includes a first gear portion (61) that rotates together with the rotation lever (31) and a second gear portion (65) that meshes with the first gear portion (61) and rotates integrally with the shutter (41A).

[5] The connector (inlet 1, inlet 1A) according to any one of [1] to [4], in which the rotation lever (31) is configured such that a longitudinal direction side portion (31*a*) of the lever front end portion (31A) is parallel to the connector fitting direction in a case that the fitting tip end portion is moved to the position facing the front opening (30), and the longitudinal direction side portion (31*a*) is engaged with a fitting guide groove (85) formed along the connector fitting direction in a housing (plug housing 80) of the mating connector (inlet plug 5) that faces the lever front end portion (31A) to guide the housing (plug housing 80) of the mating connector (inlet plug 5) into the front opening (30) of the housing (10).

According to the connector having the above configuration [1], when the mating connector is moved to the position where the fitting tip end portion faces the front opening of the housing when fitting the connector, a side surface portion of the mating connector presses the lever front end portion so as to rotate the rotation lever. Then, the rotated rotation lever rotates the shutter via the interlocking rotation mechanism so as to open the front opening of the housing. Therefore, if the mating connector is moved toward the front opening along the connector fitting direction while the side surface portion presses the lever front end portion to maintain an opening state of the shutter, the fitting tip end portion of the mating connector can be fitted to the front opening of the housing.

At this time, since the rotation lever rotates the shutter via the interlocking rotation mechanism, a pressing force with which the side surface portion of the mating connector presses the lever front end portion is smaller than a pressing force with which a fitting tip end portion of a mating connector in related art directly presses a front surface portion of a shutter.

Therefore, although insertion resistance when coupling the connection terminal and the mating connection terminal acts on the mating connector moving in the connector fitting direction when fitting the connector, rotation resistance against rotation of the shutter has almost no effect, and thus a force for fitting the connector is lower than that in the related art.

In addition, according to the connector of the present configuration, it is not necessary to lengthen a fitting hood portion of the mating connector in consideration of opening and closing trajectories of the shutter as in the shutter-mechanism-equipped connector in the related art.

According to the connector having the above configuration [2], the rotation speed of the rotation lever is increased by the speed increasing mechanism so as to rotate the shutter. Therefore, rotation necessary for the rotation lever to open the shutter is reduced, and thus a stroke (stroke in a direction intersecting the connector fitting direction) for the side surface portion of the mating connector to press the lever front end portion can be reduced. As a result, a work space required in the direction intersecting the connector fitting direction when fitting the mating connector to the connector is reduced.

According to the connector having the above configuration [3], the rotation lever pressed and rotated by the side surface portion of the mating connector can rotate the shutter by the simple interlocking rotation mechanism constituted by the multi-link mechanism provided between the rotation lever and the shutter so as to open and close the front opening of the housing.

According to the connector having the above configuration [4], the rotation lever pressed and rotated by the side surface portion of the mating connector can rotate the shutter by the simple interlocking rotation mechanism constituted by the gear mechanism provided between the rotation lever and the shutter so as to open and close the front opening of the housing.

According to the connector having the above configuration [5], when fitting the connector, the longitudinal direction side portion of the lever front end portion of the rotation lever is parallel to the connector fitting direction, so that the longitudinal direction side portion of the rotation lever is engaged with the fitting guide groove formed in the housing of the mating connector. Therefore, when the mating connector is moved toward the front opening of the connector along the connector fitting direction, the longitudinal direction side portion can guide the fitting tip end portion of the mating connector to be fitted into the front opening of the housing, and thus the two connectors can be smoothly fitted to each other.

What is claimed is:

1. A connector comprising:

a housing configured to accommodate a connection terminal;

a shutter that is rotatably provided in the housing and is configured to open and close a front opening of the housing to which a fitting tip end portion of a mating connector is to be fitted;

a rotation lever that is disposed on one side portion side of the front opening and is rotatably supported to the housing about a rotation axis intersecting a connector fitting direction of the mating connector, the rotation lever having a lever front end portion that extends toward a front side of the housing relative to the rotation axis; and an interlocking rotation mechanism provided between the rotation lever and the shutter and configured to rotate the shutter in accordance with rotation of the rotation lever, wherein a pressing force of the mating connector, whose fitting tip end portion is moved to a position facing the front opening, acts on the lever front end portion so as to rotate the rotation lever, and thus the shutter is rotated by the interlocking rotation mechanism so as to open the front opening.

2. The connector according to claim 1, wherein the interlocking rotation mechanism includes a speed increasing mechanism configured to increase a speed of the rotation of the rotation lever to rotate the shutter.

3. The connector according to claim 1, wherein the interlocking rotation mechanism includes a first link and a second link which is rotatably connected to the first link, and an end portion of the first link is pivotally supported by a lever rear end portion of the rotation lever extending toward a rear side of the housing relative to the rotation axis and an end portion of the second link is pivotally supported by a swinging portion of the shutter.

4. The connector according to claim 1, wherein the interlocking rotation mechanism includes a first gear portion that rotates together with the rotation lever and a second gear portion that meshes with the first gear portion and rotates together with the shutter.

5. The connector according to claim 1, wherein the rotation lever is configured such that a longitudinal direction side portion of the lever front end portion is parallel to the connector fitting direction in a case that the fitting tip end portion is moved to the position facing the front opening, and the longitudinal direction side portion is engaged with a fitting guide groove formed along the connector fitting direction in a housing of the mating connector that faces the lever front end portion to guide the housing of the mating connector into the front opening of the housing of the connector.

* * * * *